US006121562A

United States Patent [19]

Green et al.

[11] Patent Number: 6,121,562

[45] **Date of Patent: *Sep. 19, 2000**

[54] CIRCUIT BREAKER TERMINAL SHIELD WITH INTEGRAL SECURING AND INSTALLATION AND REMOVAL FEATURES METHOD

[75] Inventors: Russell B. Green, Douglasville; W. Dale Robbins, Lithonia; Michael W. Souza, Monroe, all of Ga.

[73] Assignee: Siemens Energy & Automation, Inc., Alpharetta, Ga.

[ * ] Notice: This patent is subject to a terminal disclaimer.

[21] Appl. No.: 08/884,793

[22] Filed: Jun. 30, 1997

[51] Int. Cl.[7] ..... H01H 9/02

[52] U.S. Cl. ..... 200/304

[58] Field of Search ..... 200/304, 293, 200/322, 305; 361/601, 641, 659, 672, 679; 174/138 F; 139/135, 718

[56] References Cited

U.S. PATENT DOCUMENTS 2,727,965 12/1955 Toth et al. ..... 200/304
3,748,654 7/1973 Sutherland ..... 340/177 R
4,520,423 5/1985 Sutherland ..... 361/380
5,150,091 9/1992 Hart et al. ..... 335/202
5,304,761 4/1994 Rosen et al. ..... 200/144 R

*Primary Examiner*—Renee Luebke

[57] ABSTRACT

A circuit breaker terminal shield with integral securing and installation and removal features method for fastening a circuit breaker terminal shield apparatus to at least one terminal end of a circuit breaker assembly having at least one circuit breaker terminal, at least one fastening aperture associated with a circuit breaker projecting end member and another circuit breaker projecting end member, the method for fastening the circuit breaker terminal shield apparatus comprising the steps of fastening a first terminal shield fastening member, which is adapted to fasten the terminal shield main frame member, to the circuit breaker projecting end member of the circuit breaker assembly, and fastening a second terminal shield fastening member, which is adapted to further fasten the terminal shield main frame member, to the another circuit breaker projecting end member of the circuit breaker assembly.

15 Claims, 6 Drawing Sheets

20
30
40
41c
40a
30c
30b
33c
41b
69b
42c
68c
64b
66c
67b
67c
51
60
66b
41a
42b
66a
65
52c
67a
41
68a
68b
55
42a
33a
64a
64c
63b
36b
64
57c
61b
62d
63a
62c
62b
57b
62a
61a
36a
56c
56b
80
30a
52a
82c
57a
82d
82a
56a
82b
82
54
58c
85
81
84
83
35b
58b
35a
58a
50

30
58c
30b
56c
58b
36b
57c
50
55
36a
37b
54
56b
31b
58a
37a
51
57b
56a
52c
35b
61b
62c
62d
62a
31a
62b
30c
61a
30a
40b
35a
42c
57a
33c
40
43c
62g
34b
52a
62f
62e
60
42b
84
83
85a
85b
42a
34a
81
33a
82b
43a
82a
30a
82
82d
82c
85
80
20

CIRCUIT BREAKER TERMINAL SHIELD WITH INTEGRAL SECURING AND INSTALLATION AND REMOVAL FEATURES METHOD

BACKGROUND OF THE INVENTION

Field of the Invention

The inventions described in this application relate to an apparatus, means, system and method for providing a circuit breaker with a circuit breaker terminal shield with integral securing and installation and removal features that may be installed or removed by an operator without using tools. Also, the circuit breaker terminal shield with integral securing and installation and removal features apparatus and means includes an integral circuit breaker installation and removal feature that provides finger holds to assist or otherwise aid a person in either mounting, otherwise installing or removing a circuit breaker on or from its circuit breaker mounting location. The circuit breaker terminal shield with integral securing and installation and removal features apparatus and means further includes an integral terminal shield securing or sealing feature to inhibit unauthorized or unintentional access to the circuit breaker terminals or removal of the circuit breaker, and which may aid in indicating whether there has been unauthorized tampering with the circuit breaker assembly.

Thus, the inventions described herein are believed to provide a relatively elegant, cost effective and reliable apparatus, means, system and method for providing a circuit breaker with a circuit breaker terminal shield apparatus and means, which has an integral circuit breaker installation and removal feature and an integral circuit breaker terminal shield securing or sealing feature, that may be easily installed or removed by an operator without using tools.

BACKGROUND

In industrial applications, the input terminal and output terminal areas or ends of circuit breaker assemblies may need to be shielded to better protect persons from unintentionally contacting the circuit breaker terminals. It may also be desirable to provide an integral circuit breaker installation and removal feature that aids or otherwise facilitate the installation or removal of a circuit breaker assembly on or from its mounting location. It may also be desirable to provide an integral circuit breaker terminal shield securing or sealing feature that is believed to aid generally in securing or sealing a circuit breaker to inhibit unauthorized access or tampering and/or to aid in indicating whether there has been unauthorized access or tampering with the circuit breaker terminals.

SUMMARY OF THE INVENTION

It is an object of the present invention to overcome the limitations or problems of at least certain of the known approaches.

One general aspect of the invention relates to a method of shielding one or more exposed electric terminals at an end of a circuit breaker assembly, the method comprising: providing a shield, including a releasable catch, for assembly to the circuit breaker assembly in shielding relation to the one or more electric terminals; providing a shield securing member that is selectively positionable on the shield proximate the catch; assembling the shield to the circuit breaker assembly, including engaging the catch with the circuit breaker assembly, to place the shield in shielding relation to the one or more electric terminals and such that the shield cannot be disassembled from the circuit breaker assembly unless the catch is first disengaged from catching the circuit breaker assembly; and with the shield so assembled to the circuit breaker assembly, positioning the shield securing member on the shield to a position that prevents the catch from being disengaged from catching the circuit breaker assembly.

Within this general aspect, more specific aspects include: assembling the shield to the circuit breaker assembly by sliding the shield onto the circuit breaker assembly; sliding the shield securing member on the shield to position the shield securing member to the position that prevents the catch from being disengaged from catching the circuit breaker assembly; sliding the shield securing member to the position that prevents the catch from being disengaged from catching the circuit breaker assembly along a direction opposite a direction along which the shield is slid onto the circuit breaker assembly; applying a seal to the shield securing member when the latter is in the position that prevents the catch from being disengaged from catching the circuit breaker assembly to thereby prevent the catch from being disengaged from catching the circuit breaker assembly unless the seal is first broken; and applying the seal by passing a seal member through a hole in the shield securing member.

Another general aspect relates to a method of shielding one or more exposed electric terminals at an end of a circuit breaker assembly, the method comprising: providing a shield for assembly to the circuit breaker assembly in shielding relation to the one or more electric terminals; providing a shield securing member that is selectively positionable by sliding on the shield; assembling the shield to the circuit breaker assembly to place the shield in shielding relation to the one or more electric terminals; and with the shield so assembled to the circuit breaker assembly, sliding the shield securing member from a first position that allows disassembly of the shield from the circuit breaker assembly to a second position that prevents the shield from being disassembled from the circuit breaker assembly.

Within this latter general aspect, more specific aspects include: sliding the shield securing member along a straight direction on the shield; sliding the shield onto the circuit breaker assembly along a straight direction opposite the straight direction along which the shield securing member is slid on the shield; providing the shield with a catch that, when the shield is assembled to the circuit breaker assembly, catches with the circuit breaker assembly to prevent disassembly of the shield from the circuit breaker assembly unless the catch is first released from catching with the circuit breaker assembly, and sliding the shield securing member from a first position that allows the catch to be released to a second position that prevents the catch from being released; providing the shield with two registering apertures, and sliding the shield securing member from the first position to the second position to pass a portion of the shield securing member through the two apertures; applying a seal to the shield securing member when the latter is in the second position to prevent the shield securing member from being slid to the first position unless the seal is first broken; and applying the seal to the shield securing member when the latter is in the second position by passing a seal member through a hole in the shield securing member.

These and other objects, advantages and features of the present inventions will be readily understood and appreciated with reference to the detailed description of preferred embodiments discussed below together with the accompanying drawings.

DETAILED DESCRIPTION OF PREFERRED EMBODIMENT

Figure 1A:
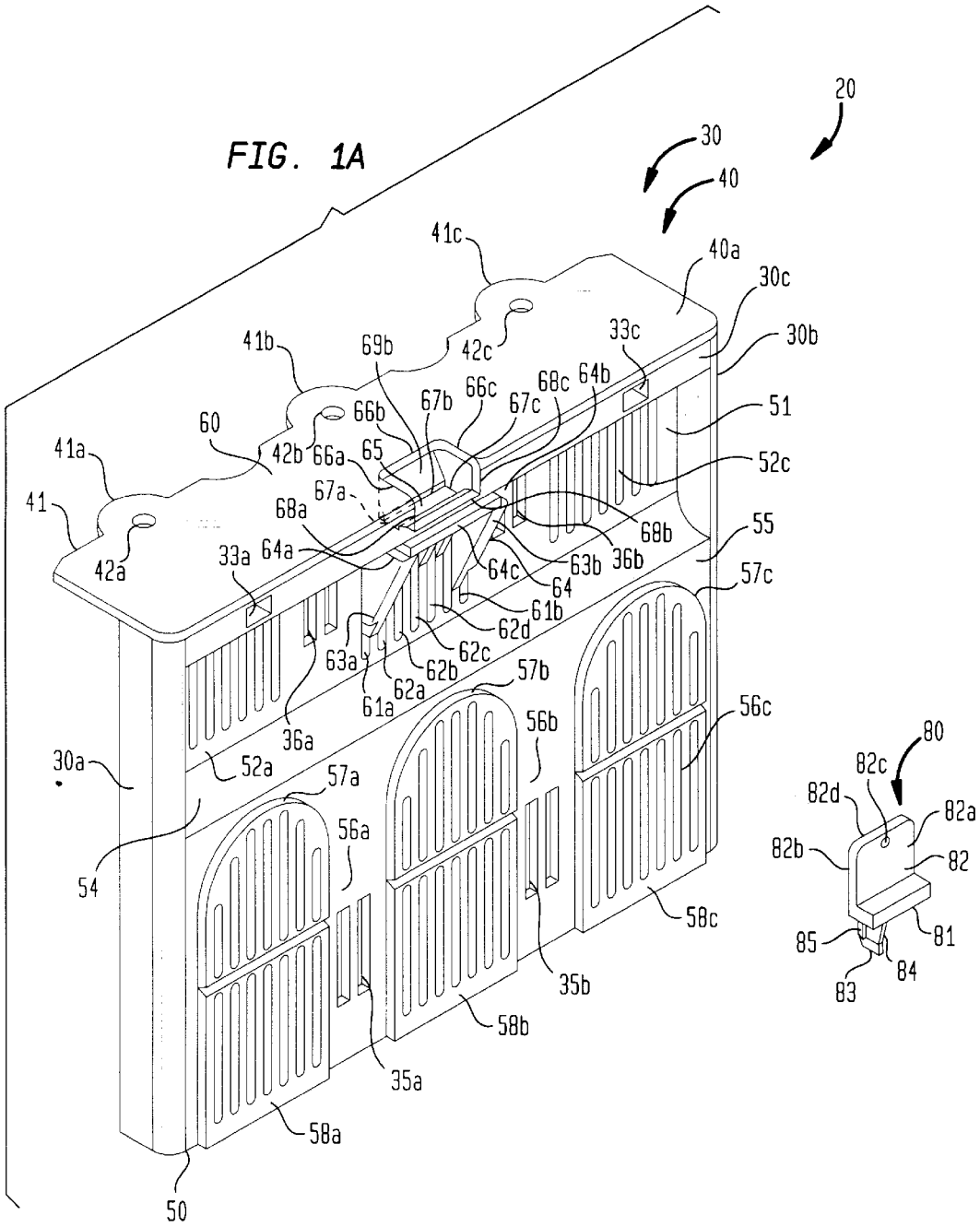
FIG. 1A is a drawing of an exterior view of one embodiment of one circuit breaker terminal shield of the circuit breaker terminal shield with integral securing and installation and removal features apparatus and means of the present inventions.

Referring to FIGS. 1A to 5, a circuit breaker terminal shield with integral securing and installation and removal features system 1 comprises two circuit breaker terminal shields with integral securing and installation and removal features assemblies or devices 20 (only one of which is shown) and a circuit breaker assembly 90. One circuit breaker terminal shield with integral securing and installation and removal features apparatus, assembly or device 20 is used to shield the input terminals 91*a,* 91*b* and 91*c* of the input terminal end 90*a* of the circuit breaker assembly 90 and another like assembly is used to shield the output terminals of the output terminal end 90*b* of the circuit breaker assembly 90. Only one circuit breaker terminal shield with integral securing and installation and removal features assembly 20 is shown since the construction is the same or essentially the same for either the input terminal end 90*a* or the output terminal end 90*b* of the circuit breaker assembly 90.

In the circuit breaker terminal shield with integral securing installation and removal features system 1, the circuit breaker assembly 90, which receives the circuit breaker terminal shield with integral securing installation and removal features assembly 20, comprises an operating or toggle handle or movable actuator 99, which may have at least an ON position, a TRIPPED position and an OFF position, and further comprises circuit breaker upper and lower horizontal projecting end members or portions 97 and 98, respectively, as well as circuit breaker left and right and left center and right center vertical projecting end members or portions 92*a,* 92*b* and 93*a,* 93*b,* respectively, at both the input and output terminal ends 90*a* and 90*b* of the circuit breaker assembly 90. The circuit breaker upper and lower horizontal projecting end members or portions 97 and 98 comprise upper access and retention apertures, holes or openings 97*a,* 97*b* and 97*c* and lower access apertures, holes or openings 98*a,* 98*b* and 98*c,* respectively. The circuit breaker input terminals 91*a,* 91*b* and 91*c* project out from the interior portion of the circuit breaker assembly 90 and into the circuit breaker terminal areas 96*a,* 96*b* and 96*c,* each of the areas being defined by two of the circuit breaker vertical projecting end members 92 and/or 93 and the lower horizontal projecting end member 98. The circuit breaker left center and right center vertical projecting end members 93*a* and 93*b* further comprise slotted dove tail apertures or openings 94*a* and 94*b,* which extend the length of the circuit breaker vertical projecting end members 93*a* and 93*b* and which are designed to receive securely terminal shield upper dove tail lug members or portions 34*a* and 34*b* and lower dove tail lug members or portions 36*a* and 36*b* of terminal shield main frame flange members 31*a* and 31*b* of a terminal shield main frame member 30, as is discussed further below.

The circuit breaker assembly 90 may further comprise push-to-trip buttons, circuit breaker lug openings or apertures and circuit breaker mounting openings or apertures. The circuit breaker assembly 90 may include an electronic trip unit, which may further include energy measurement capabilities. Further, the circuit breaker assembly 90 may be a "single" unit, or in certain arrangements, the circuit breaker assembly 90 may also comprise a separate circuit breaker unit and a corresponding mounting plug-in unit (not shown). In such an arrangement, threaded screws or bolts may be passed through the circuit breaker mounting apertures or openings and received by threaded apertures or openings in the corresponding mounting plug-in unit so as to mount the circuit breaker unit on the mounting plug-in unit. Also, the circuit breaker lug apertures or openings may be used to receive threaded copper studs, which may be plugged into copper tulip contacts that are provided in the mounting plug-in unit. In this way, a current path may be provided through the mounting plug-in unit to the circuit breaker unit.

With respect to the circuit breaker terminal shield with integral securing and installation and removal features apparatus, assembly or device 20, it comprises a terminal shield main frame member 30 and a terminal shield securing member 80. Both the terminal shield main frame member 30, which has several fastening, mounting or securing features allowing it to be fastened or mounted to a circuit breaker assembly without requiring the use of tools, and the terminal shield securing member 80 may be integrally formed or otherwise fashioned from a polycarbonate material known as Lexan 143R or from any other suitably appropriate material for use in shielding and securing circuit breaker terminals 91 of the circuit breaker assembly 90. Thus, as shown, the circuit breaker terminal shield assembly 20 comprises two formed or molded pieces, namely the terminal shield main frame member 30 and the terminal shield securing member 80.

In particular, the terminal shield securing member 80 comprises a horizontal securing flange member 81, a vertical securing flange member 82, which further comprises a securing or sealing wire receiving aperture, hole or opening 82*c,* and a vent rib snap lug supporting member 83, which further comprises a vent rib snap lug 85 and a vent rib stop member or portion 84. The vent rib stop member or portion 84 is spaced from the vent rib snap lug 85 by the depth or thickness of the vent ribs (as measured from the external face of the vent ribs to the internal face of the vent ribs) so that when the vent rib snap lug 85 is inserted, it inhibits horizontal movement of the terminal shield securing member 80. The vent rib snap lug 85 has an external face 85*a* that is wider than an internal face 85*b*. Additionally, the vent rib snap lug internal face 85*b* is displaced from the vertical securing or sealing flange member 82 by an amount that is about the thickness of upper center vent ribs 62*a,* 62*b,* 62*c,* 62*d* so that the internal face 82*b* of securing flange member 82 is adjacent to or fits firmly with respect to the external face of the upper center vent ribs, and is securely fitted since the external face 85*a* of vent rib snap lug 85 is wider than the internal face 85*b* of vent rib snap lug 85 so as to generally inhibit removal of the vent rib snap lug 85 from between upper center vent ribs 62*b* and 62*c*.

Figure 1B:
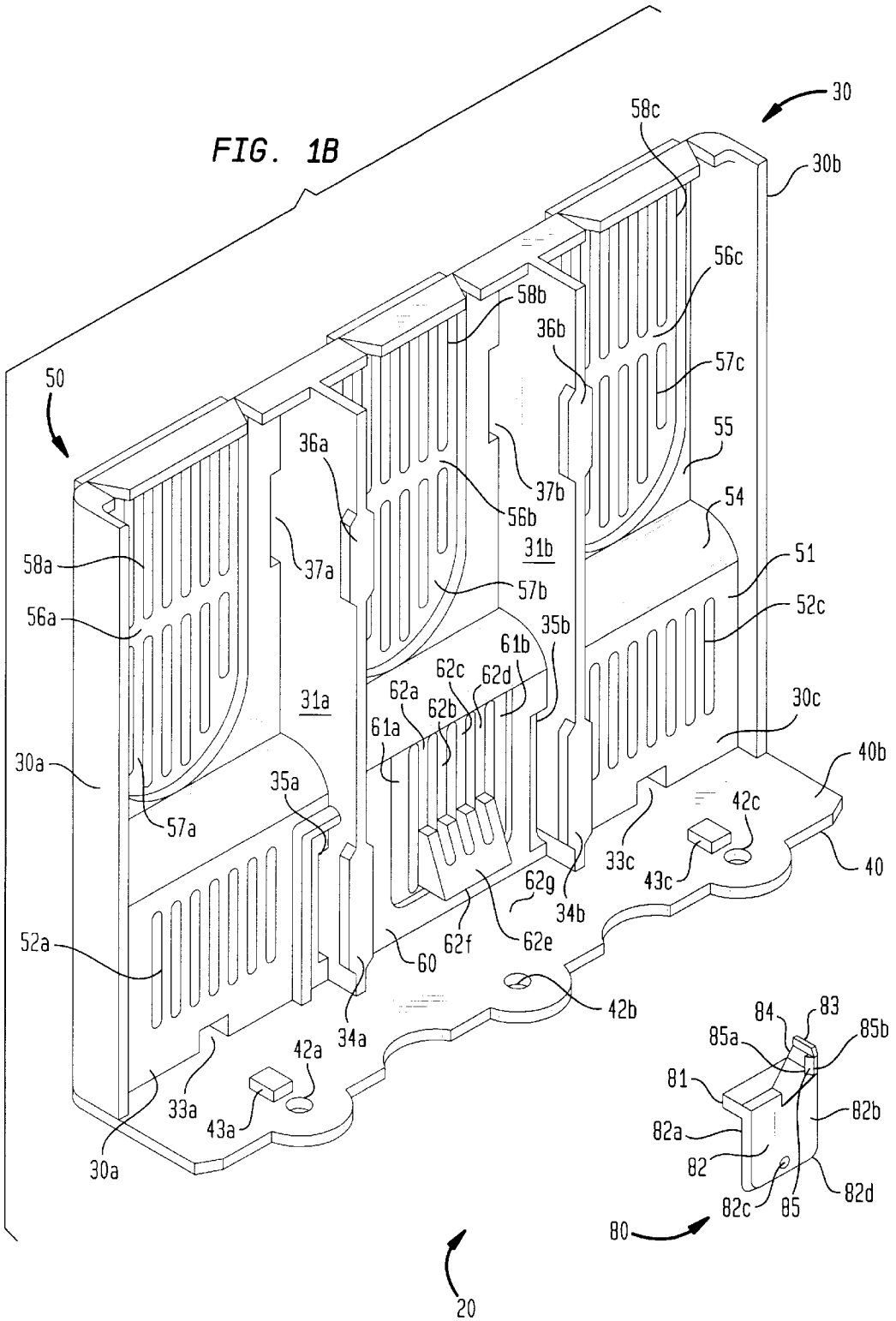
FIG. 1B is a drawing of an interior view of one embodiment of one circuit breaker terminal shield of the circuit breaker terminal shield with integral securing and installation and removal features apparatus and means of the present inventions.

In particular, the terminal shield main frame member 30 comprises terminal shield main frame access and retention member 40 and terminal shield main frame cover member 50, each of which is integrally associated with or otherwise associated in a suitably appropriate way with respect to one another. As shown in FIGS. 1A and 1B, the terminal shield main frame access and retention member 40 and terminal shield main frame cover member 50 are formed generally perpendicularly to the planes of one another. The terminal shield main frame member 30 also comprises left flange terminal shield main frame member 30*a* and right flange terminal shield main frame member 30*b,* each of which is integrally formed with or otherwise associated in a suitably appropriate way with respect to terminal shield main frame access and retention member 40 and terminal shield main frame cover member 50. As shown in FIG. 1B, the terminal shield main frame flange members 30*a* and 30*b* are formed generally perpendicularly to the planes of both terminal shield main frame access and retention member 40 and terminal shield main frame cover member 50. Terminal shield main frame flange members 30*a* and 30*b* are shaped to fit firmly or securely with respect to the rounded outside corners of the left and right vertical projecting end members or portions 92*a* and 92*b,* respectively, of the circuit breaker assembly 90.

The terminal shield main frame member 30 further comprises left center terminal shield dove tail flange member 31*a,* right center terminal shield dove tail flange member 31*b* and terminal shield main frame structural member 30*c,* each of which is integrally formed with or otherwise associated in a suitably appropriate way with respect to terminal shield main frame access and retention member 40 and terminal shield main frame cover member 50. Terminal shield main frame member 30 appears as a vertical wall. As shown in FIG. 1B, the left and right center terminal shield dove tail flange members 31*a* and 31*b* are formed generally perpendicularly to the planes of both terminal shield main frame access and retention member 40 and terminal shield main frame cover member 50. Left and right center terminal shield dove tail flange members 31*a* and 31*b* comprise upper dove tail lug members or portions 34*a* and 34*b* and lower dove tail lug members or portions 36*a* and 36*b,* respectively. The upper dove tail lug members or portions 34*a* and 34*b* and lower dove tail lug members or portions 36*a* and 36*b* are designed to fit securely within slotted dove tail apertures or openings 94*a* and 94*b,* which extend the length of the circuit breaker center vertical projecting end members 93*a* and 93*b* of the circuit breaker assembly 90, respectively. It is noted that corresponding upper dove tail lug aperture or opening sets 35*a* and 35*b* and lower dove tail lug aperture or opening sets 37*a* and 37*b,* which are formed in the upper and lower terminal shield access cover portions 51 and 55, respectively, are provided so that the upper dove tail lug members or portions 34*a* and 34*b* and lower dove tail lug members or portions 36*a* and 36*b* may be integrally formed or molded by introducing molding material through the dove tail lug aperture or opening sets 35*a* and 35*b* and lower dove tail lug aperture or opening sets 37*a* and 37*b*.

Terminal shield main frame member 30 also comprises a circuit breaker upper horizontal projecting member fastening or mounting portion 60, which is integrally formed with or otherwise associated in a suitably appropriate way with respect to the upper center outside edge area of terminal shield main frame member 30. In particular, upper left inner edge 66*a,* upper center inner edge 66*b* and upper right inner edge 66*c* of the terminal shield main frame access and retention member 40 define the upper boundaries of a securing device receiving aperture or opening 65, which is located at the outside center edge area of the terminal shield access and retention external face 40*a*. Additionally, lower left inner edge 67*a,* lower center inner edge 67*b* and lower right inner edge 67*c* partially define the lower inner boundaries, which are located at the inner portion of the terminal shield main frame structural member 30*c*. As shown, the lengths of lower inner edges 67*a* and 67*c* (which are the same length) are less than the lengths of upper inner edges 66*a* and 66*c* (which are also the same length). Finally, vertical left outer edge 68*a,* vertical right outer edge 68*c* and lower center outer connecting member or portion 68*b* define the connecting boundaries between the upper inner boundaries 66*a,* 66*b,* 66*c* and the lower inner boundaries 67*a,* 67*b,* 67*c*. Also, lower inner edges 67, vertical outer edges 68*a,* 68*c* and lower center outer connecting member 68*b* define the upper securing device receiving aperture or opening 65. The securing flange member 82 of the securing member 80 is inserted through the securing flange member receiving aperture or opening 65. Since left and right lower inner edges 67*a,* 67*c* are shorter than upper inner edges 66*a,* 66*c* the inner fastening or mounting segment 69*b* is sloped downwardly from the external face 40*a* generally in the direction of the lower center connecting member 68*b* of the terminal shield main frame cover member 50. In this way, the sealing wire 86 may be more easily inserted or passed through the sealing wire aperture, hole or opening 82*c* since the upper edge 82*d* of the securing or sealing flange member 82 is generally flush with respect to the terminal shield access and retention external face 40*a*.

Figure 2:
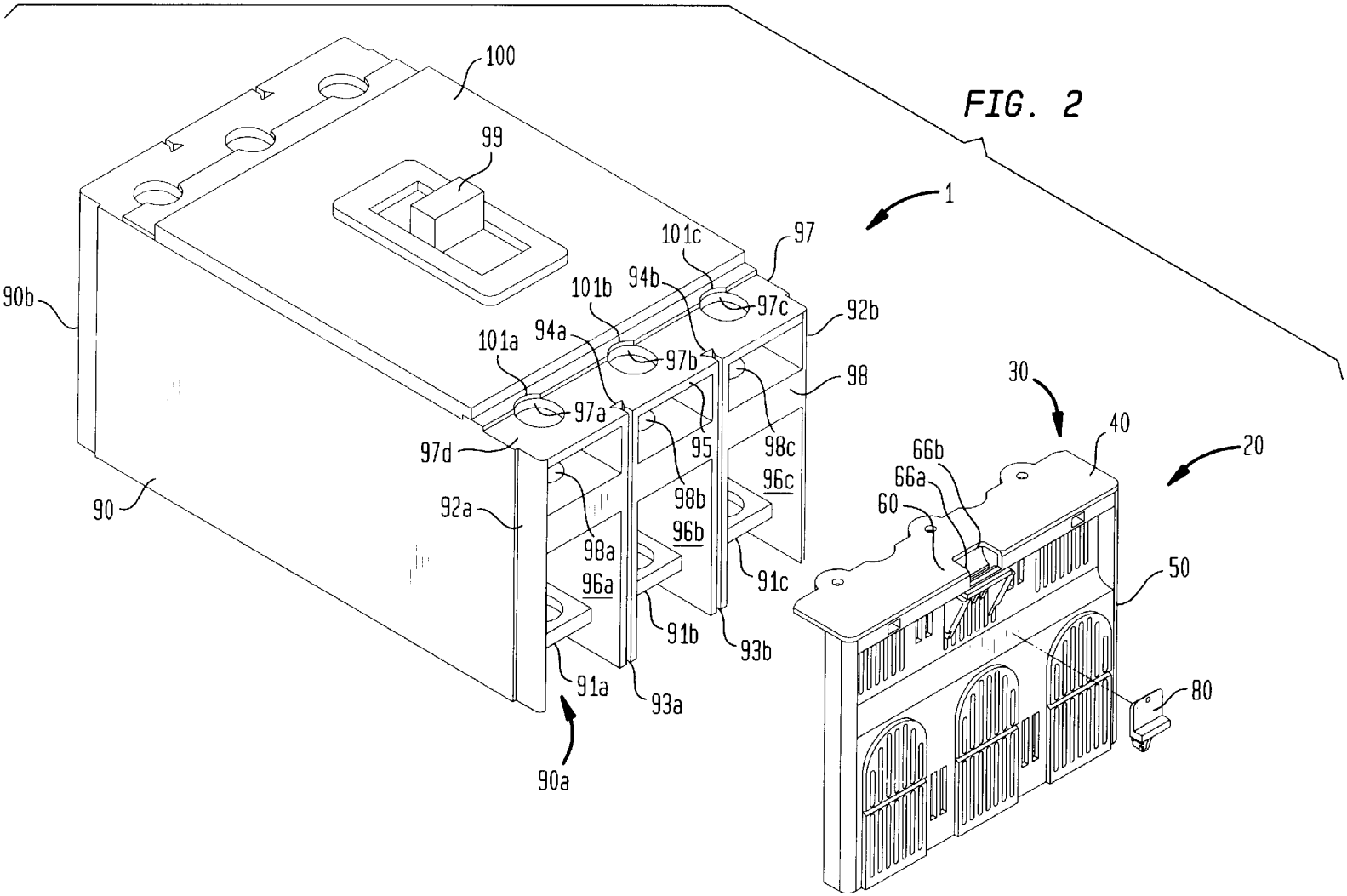
FIG. 2 is a drawing of the apparatus, means and system and method of the present inventions showing one circuit breaker terminal shield and circuit breaker assembly of the circuit breaker terminal shield securing and installation and removal features apparatus, means and system.
Figure 3:
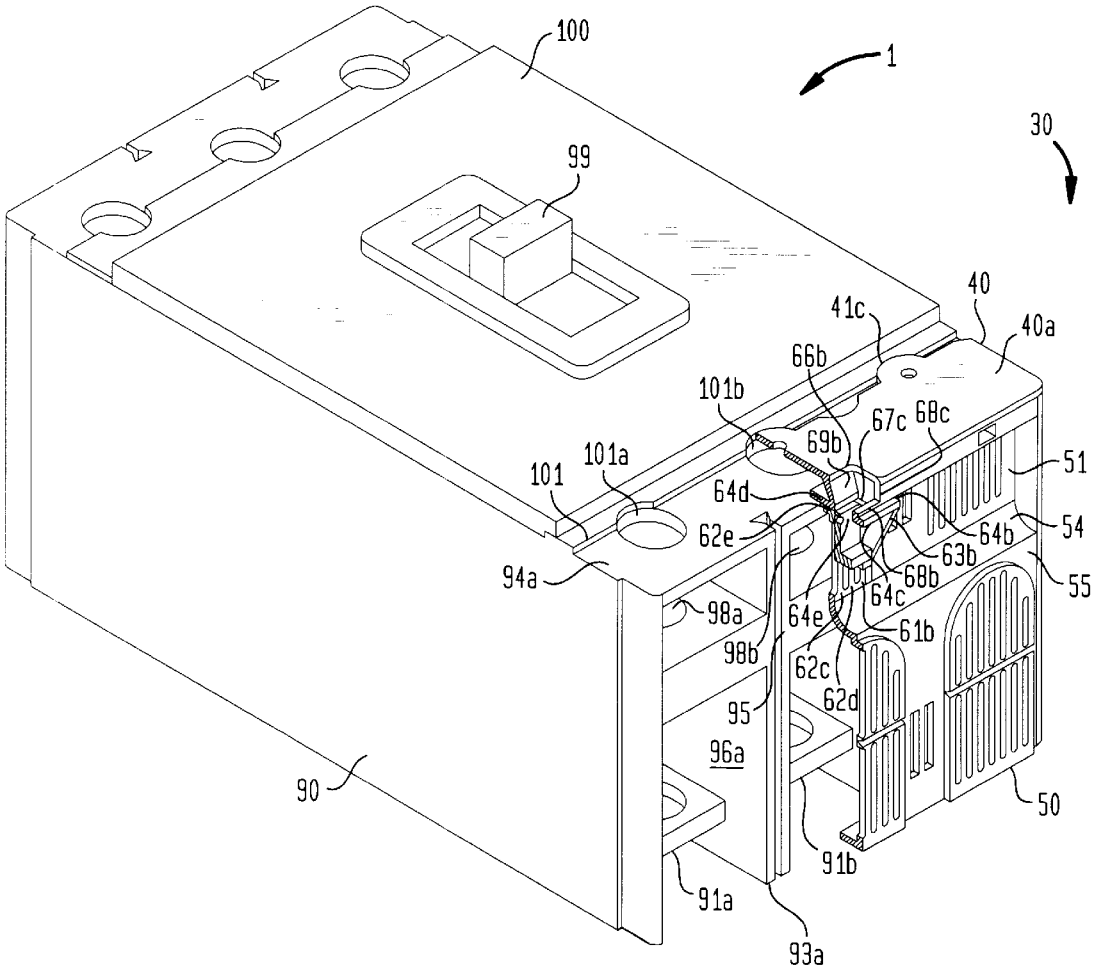
FIG. 3 is a drawing of the apparatus, means, system and method of the present inventions showing a partial view of one circuit breaker terminal shield of the circuit breaker terminal shield with integral securing and installation and removal features apparatus and means when installed or otherwise mounted on a input terminal end of the circuit breaker assembly.

The circuit breaker fastening or mounting member or portion 60 comprises integrally formed upper center vent ribs 61*a,* 61*b* and 62*a,* 62*b,* 62*c,* 62*d*. In particular, as shown in FIGS. 1 to 3, formed integrally with the vent ribs is a lower securing device receiving structural member 64 having a lower securing device receiving aperture or opening 64*e*. The lower securing device receiving aperture or opening 64*e* is defined by left and right structural segments 64*a* and 64*b* and by external and internal structural members 64*c* and 64*d,* which are integrally formed or otherwise associated with left and right vent rib triangular projecting members 63*a* and 63*b,* which project externally and outwardly from and which are integrally formed or otherwise associated with left and right upper vent ribs 61*a* and 61*b*, respectively. Additionally, the upper internal side of the vent ribs 62*a*, 62*b*, 62*c* and 62*d* comprises a fastening or mounting extension member or portion 62*e*, which extends generally inwardly in the direction of the circuit breaker movable actuator 99 and which has an upper face 62*f* that is displaced or separated from an internal face 40*b* of the terminal shield main frame access and retention member 40 so that a center portion 95 of the circuit breaker upper horizontal projecting member 97 firmly or securely fits within an area 62*g* defined by the upper face 62*f* of the fastening or mounting extension member or portion 62*e* and the terminal shield access and retention internal face 40*b*. In its normal position, the lower securing device receiving aperture or opening 64*e* is vertically aligned with the upper securing device receiving aperture or opening 65. The securing vertical flange member 82 may be inserted through the lower and upper securing device receiving apertures or openings 64*e* and 65, respectively, until an upper face 81*a* of the securing horizontal flange member 81 is seated adjacent to or firmly with respect to a lower face of the lower securing or sealing device receiving structural segments 64*a*, 64*b*, 64*c* and 64*d*.

Terminal shield main frame access and retention member 40 also comprises left and right terminal shield main frame retention projecting members or tabs 43*a* and 43*c*, which are designed to fit within the upper left and right access and retention apertures, holes or openings 97*a* and 97*c*, respectively, which are formed in the circuit breaker upper horizontal projecting end member or portion 97 of the circuit breaker assembly 90. In particular, circuit breaker upper left and right access and retention apertures, holes or openings 97*a* and 97*c* receive terminal shield main frame retention projecting members or tabs 43*a* and 43*c*, respectively. It is noted that corresponding left and right terminal shield retention molding apertures or openings 33*a* and 33*c*, which are formed in the terminal shield main frame member 30*c*, as shown, are provided so that the left and right terminal shield main frame retention projecting members or tabs 43*a* and 43*c* may be integrally formed or molded by introducing molding material through the left and right terminal shield molding apertures or openings 33*a* and 33*c*.

Also, the upper outer contoured edge 41 of the terminal shield access and retention member 40 is contoured or shaped to fit firmly or securely with respect to the upper outer edge 101 of the circuit breaker face plate 100. In particular, the curved or nonlinear portions 41*a*, 41*b* and 41*c* are contouredly seated adjacent to or firmly with respect to the at least partially curved or contoured upper outer edges 101*a*, 101*b* and 101*c* of the circuit breaker face plate 100, which at least partially conform to or define the circuit breaker access and retention apertures, holes or openings 97*a*, 97*b* and 97*c*. Finally, terminal shield access and retention member 40 comprises terminal shield access apertures, holes or openings 42*a*, 42*b* and 42*c*, which may be used to allow a voltage probe, for example, to access the circuit breaker terminals 91 without having to remove the terminal shield main frame member 30.

With respect to the terminal shield main frame cover member 50, it comprises upper recessed cover portion or member 51 and lower cover portion or member 55. Upper recessed cover portion or member 51 and lower cover portion or member 55 are connected by a curved or nonlinear cover segment 54. The upper recessed cover portion or member 51 allows a person to more easily grasp the circuit breaker assembly 90 having a terminal shield assembly 20 at both the input terminal end 90*a* and the output terminal end 90*b* to facilitate mounting or removal of the circuit breaker assembly 90. Also, terminal shield upper recessed cover portion or member 51 comprises upper recessed vent sections 51*c* and 52*c*, all of which are integrally formed with or otherwise associated in a suitably appropriate way with respect to terminal shield main frame cover member 50. Additionally, terminal shield lower cover portion or member 55 comprises lower vent sections 56*a*, 56*b* and 56*c*, which further comprise lower vent sections 57*a*, 57*b* and 57*c* and adjacent removable lower vent sections 58*a*, 58*b* and 58*c*, all of which are integrally formed with or otherwise associated in a suitably appropriate way with respect to terminal shield main frame cover member 50. Further, the adjacent removable lower vent sections 58*a*, 58*b* and 58*c* are relatively easy to remove since their left, upper and right sides are integrally connected to the remainder of the terminal shield main frame cover member 50 by only a relatively small amount of molding material on the order of about two one-hundredths of an inch (0.02 inches). The removable lower vent sections 58*a*, 58*b* and 58*c* may be removed to connect terminal conductors (not shown) to the circuit breaker terminals 91 if the circuit breaker assembly is not a plug-in unit type circuit breaker assembly. If, however, the circuit breaker assembly 90 is a plug-in type unit having a circuit breaker unit and a mounting plug-in unit for mounting and receiving the circuit breaker unit, as discussed above, then the lower vent sections 58 need not be removed to connect the terminal conductors since the conductive path is provided by the plug-in arrangement of the plug-in type circuit breaker assembly 90.

The circuit breaker terminal shield with integral securing and installation and removal features assembly 20 attaches to, is fastened or is otherwise mounted on the circuit breaker assembly 90 in the following way:

To install a terminal shield main frame member 30, it is first grasped or otherwise taken and positioned directly over the circuit breaker upper horizontal projecting member 97 so that the left center and right center terminal shield dove tail flange members 31*a* and 31*b* are vertically aligned with the left center and right center terminal shield slotted dove tail receiving apertures or openings 94*a* and 94*b*, respectively. The terminal shield main frame member is then moved downwardly so as to fittedly insert left center and right center terminal shield dove tail flange members 31*a* and 31*b* into left center and right center terminal shield slotted dove tail receiving apertures or openings 94*a* and 94*b*. In particular, upper and lower left dove tail lug members or portions 34*a* and 36*a* and upper and lower right dove tail lug members or portions 34*b* and 36*b* are fittedly inserted into left and right dove tail lug receiving apertures or openings 94*a* and 94*b*, respectively. The terminal shield main frame member 30 is then slid downwardly until the internal or lower face 40*b* of the terminal shield access and retention member 40 is seated adjacent to or firmly with respect to an external face 97*d* of the circuit breaker upper horizontal projecting member. Also, it is noted that as the terminal shield main frame member 30 is slid downwardly, the fastening or mounting extension member or portion 62*e* will move, as the lower portion of vent ribs bend at their base, laterally outwardly away from the input terminal end 90*a* of the circuit breaker assembly 90, and will move back to its normal position so as to snappedly fasten, i.e. catch to the circuit breaker upper horizontal center portion 95 of the circuit breaker upper horizontal projecting member 97. This organization and arrangement of elements 61*a*, 61*b*, 62*a*, 62*b*, 62*c*, 62*d*, 64*a*, 6*b*, 64*c*, 64*d* forms a releasable catch 200 on the shield. As member 30 is slid downward toward final installed position on the circuit breaker, catch 200 is deflected, and upon member 30 having attained final installed position, the catch snaps back, thereby releasably catching member 30 on circuit breaker portion 95. In this position the curved or nonlinear portions 41*a,* 41*b* and 41*c* are contouredly seated adjacent to or firmly with respect to the at least partially curved contoured upper outer edges 101*a,* 101*b* and 101*c* of the circuit breaker face plate 100, which at least partially conform to or define the access and retention apertures, holes or openings 97*a,* 97*b* and 97*c.* Also, as discussed, terminal shield main frame access and retention member 40 comprises left and right terminal shield main frame retention projecting members or tabs 43*a* and 43*c* that will be seated within the upper left and right access and retention apertures, holes or openings 97*a* and 97*c,* respectively, which are formed in the circuit breaker upper horizontal projecting end member or portion 97 of the circuit breaker assembly 90. In particular, circuit breaker upper left and right access and retention apertures, holes or openings 97*a* and 97*c* receive terminal shield main frame retention projecting members or tabs 43*a* and 43*c,* respectively, so as to inhibit lateral movement of the terminal shield main frame member 30 outwardly away from the input terminal side 90*a* or outwardly away from the output terminal side 90*b* under short circuit conditions, for example. Further, as discussed, terminal shield main frame flange members 31*b* and 30*b* are shaped to fit firmly or securely with respect to the outside partially curved or non-linear ends or portions along the outer left and right vertical projecting end members or portions 92*a* and 92*b,* respectively, of the circuit breaker assembly 90.

Figure 4:
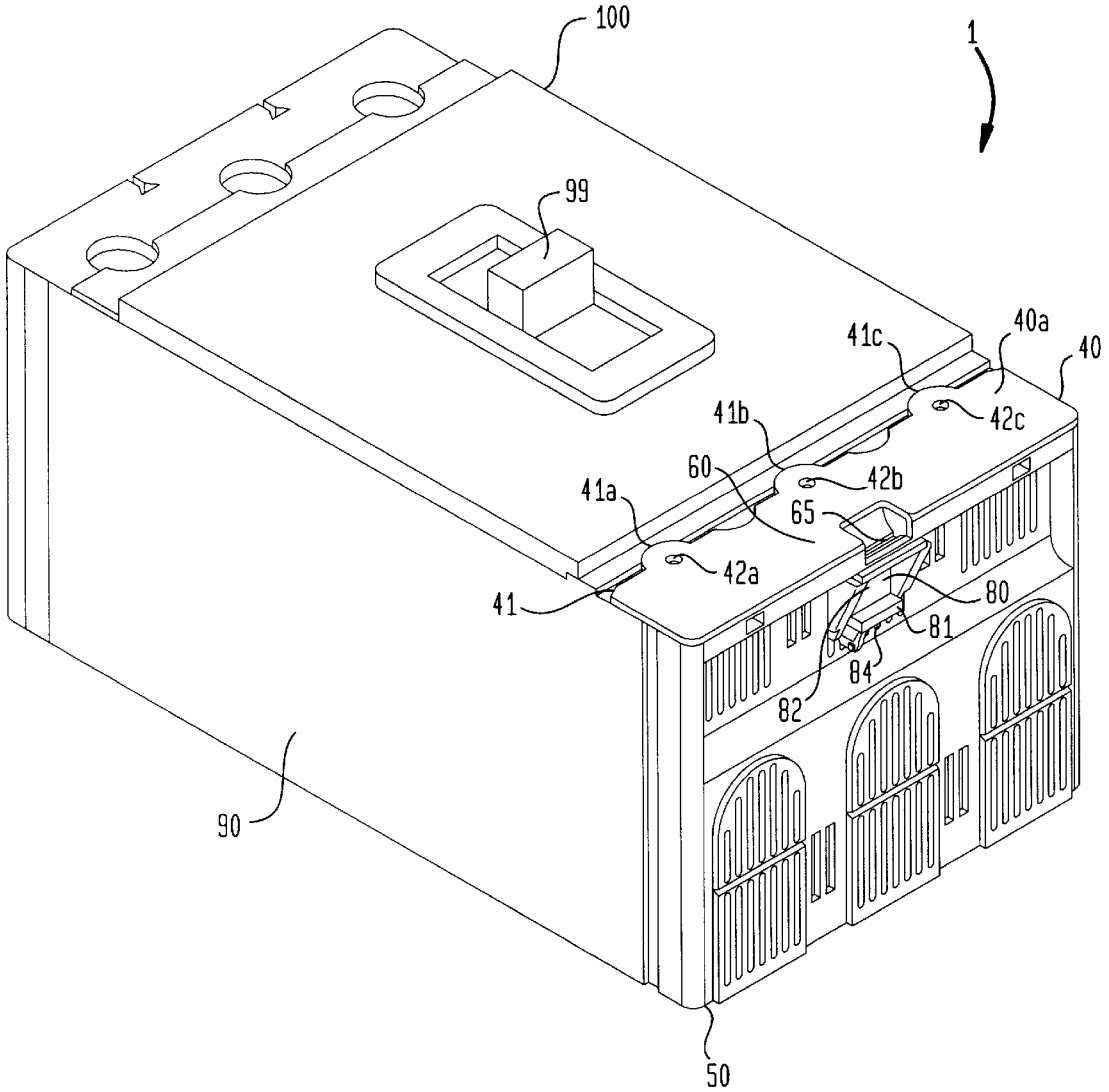
FIG. 4 is a drawing of the apparatus, means, system and method of the present inventions showing a full view of one circuit breaker terminal shield of the circuit breaker terminal shield with integral securing and installation and removal features apparatus and means when installed or otherwise mounted on the input terminal end of the circuit breaker assembly.
Figure 4A:
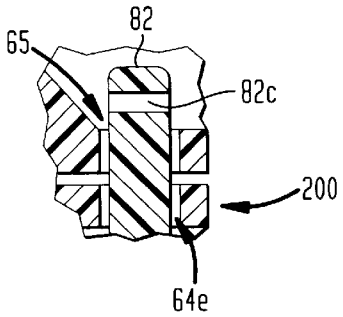
FIG. 4A is an enlarged cross section view along line 4A—4A in FIG. 4.
Figure 5:
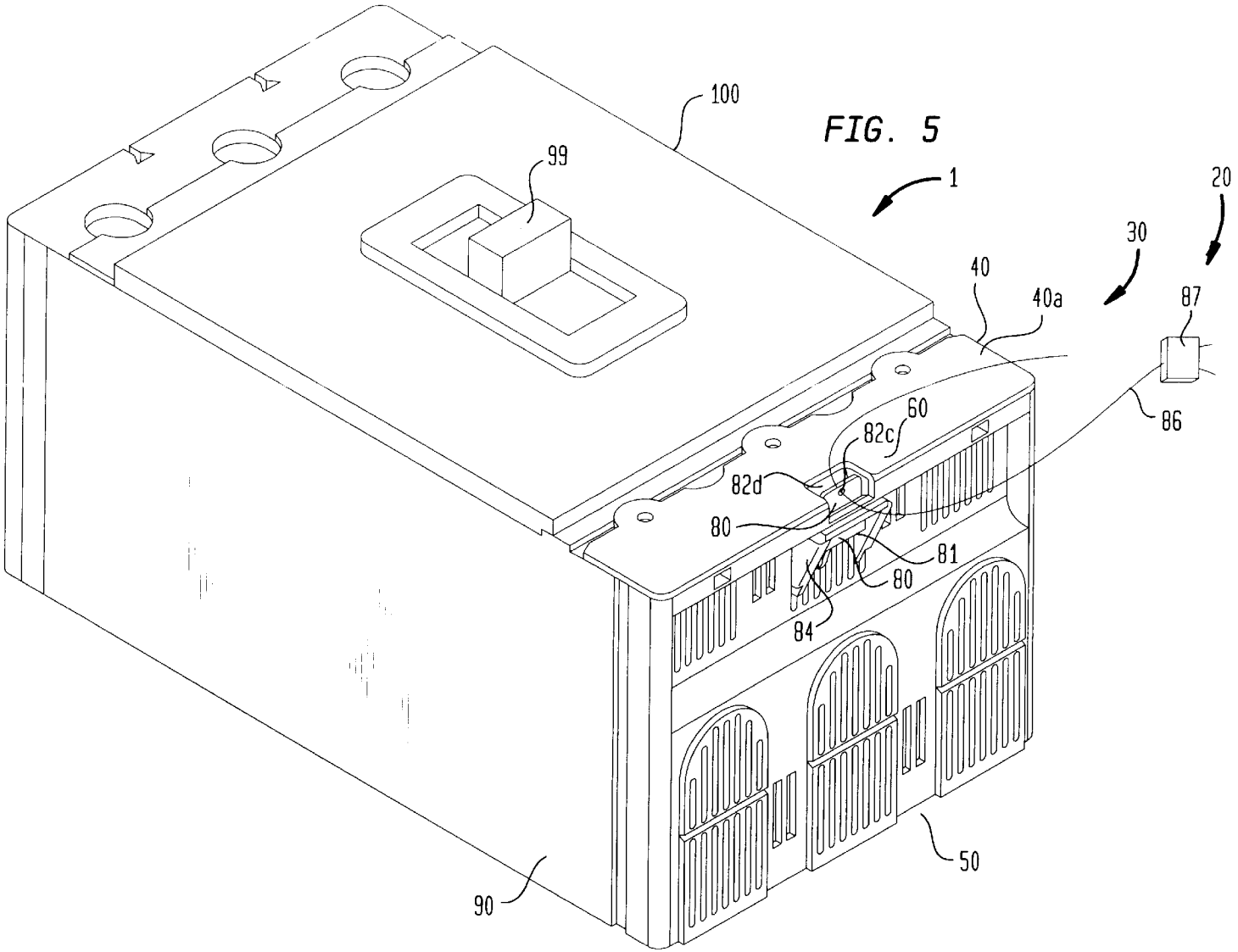
FIG. 5 is a drawing of the apparatus, means and system of the present inventions showing a full view of one circuit breaker terminal shield of the circuit breaker terminal shield with integral securing and installation and removal features apparatus and means when installed or otherwise mounted on the input terminal end of the circuit breaker assembly, and in which the circuit breaker assembly and circuit breaker terminal shield has been secured or sealed by a terminal shield securing or sealing wire and a terminal shield securing or sealing clamp.

After the terminal shield main frame member 30 has been installed, the terminal shield securing or sealing member 80 is grasped and positioned so that the upper edge 82*d* of securing or sealing vertical flange member 82 is positioned below or underneath the upper and lower securing or sealing device receiving apertures or openings 65 and 64*e.* The terminal shield snap lug 85 is then inserted between two upper center vent ribs 62*b* and 62*c* until it snaps in so that its removal is inhibited and stop member 84 cooperates with vent rib snap lug 85 to allow vertical but not horizontal movement or sliding so that terminal shield securing member 80 may be vertically moved or slid so as to insert the terminal shield securing vertical flange member 82 through the upper and lower securing or sealing device receiving apertures or openings 65 and 64*e* until the upper edge 82*d* of the securing vertical flange member 82 is generally flush with respect to the terminal shield access and retention external face 40*a.* FIG. 4A shows this position where catch 200 is catching member 30 on circuit breaker 90. Next, the sealing wire 86 may be inserted through the sealing wire receiving aperture or opening 82*c,* and then the sealing wire 86 may be sealed by the sealing clamp 87. Any other suitably appropriate sealing apparatus or device may, however, be used instead of wire 86 and wire clamp 87. To remove the circuit breaker terminal shield main frame member 30, after first having removed the terminal shield securing or sealing member 80, a user needs to grasp the circuit breaker upper horizontal projecting member fastening portion 60 by the left and right vent rib triangular projecting members 63*a* and 63*b,* respectively, and move it laterally or outwardly away from the input terminal end 90*a* of the circuit breaker assembly 90 so as to unfasten it from the circuit breaker center portion 95. Thereafter, the terminal shield main frame member may be slid upwardly so as to remove the left center and right center terminal shield dove tail flange members 31*a* and 31*b,* as well as corresponding upper and lower left dove tail lug members or portions 34*a* and 36*a* and upper and lower right dove tail lug members or portions 34*b* and 36*b,* from the left center and right center terminal shield slotted dove tail receiving apertures or openings 94*a* and 94*b.* Also, of course, left and right terminal shield main frame retention projecting members or tabs 43*a* and 43*c* will be unseated or removed from the upper left and right access and retention apertures, holes or openings 97*a* and 97*c,* respectively, which are formed in the circuit breaker upper horizontal projecting end member or portion 97 of the circuit breaker assembly 90.

In the foregoing way, the circuit breaker terminal shield assembly 20, including the terminal shield main frame member 30 and the terminal shield securing member 80, may be fastened or mounted or removed to or from a circuit breaker assembly 90 without requiring the use of tools, while also providing the integrated circuit breaker installation and removal feature and the integrated terminal shield securing or sealing feature.

Hence, it has been disclosed that terminal shield main frame member 30 is formed with a catch that catches with circuit breaker upper horizontal center portion 95 of the circuit breaker upper horizontal projecting member 97 when terminal shield main frame member 30 has been slid fully downward on circuit breaker assembly 90 to shield the exposed electric terminals. With terminal shield securing member 80 having been slid upward to pass vertical flange member 82 through registered apertures 64*e* and 65, that flange member assumes a position that prevents the catch from being released by grasping members 63*a* and 63*b* and pulling on the catch. Applying the seal 86, 87, as described, prevents member 80 from being slid downward and moving member 82 out of the way of the catch. Only after the seal has been broken, and removed, can member 80 be slid downward to move member 82 out of the way of the catch, whereupon the catch can be grasped at 63*a,* 63*b,* and pulled to release it from engagement with the circuit breaker assembly and allow member 30 to be slid upward and once again allow exposure of the circuit breaker's electric terminals.

While the present invention has been described in connection with what are believed to be the practical and preferred embodiments as currently contemplated, it should be understood that the present invention is not limited to the specifically disclosed embodiments. Accordingly, the present invention is intended to cover various modifications and comparable arrangements, methods and structures that are within the spirit and scope of the claims.

What is claimed is:

1. A method of shielding one or more exposed electric terminals at an end of a circuit breaker assembly, the method comprising:

providing a shield, including a releasable catch, for assembly to the circuit breaker assembly in shielding relation to the one or more electric terminals;

providing a shield securing member that is selectively positionable on the shield proximate the catch;

assembling the shield to the circuit breaker assembly, including engaging the catch with the circuit breaker assembly, to place the shield in shielding relation to the one or more electric terminals and such that the shield cannot be disassembled from the circuit breaker assembly unless the catch is first disengaged from catching the circuit breaker assembly; and with the shield so assembled to the circuit breaker assembly, positioning the shield securing member on the shield to a position that prevents the catch from being disengaged from catching the circuit breaker assembly.

2. A method as set forth in claim 1 in which the step of assembling the shield to the circuit breaker assembly comprises sliding the shield onto the circuit breaker assembly.

3. A method as set forth in claim 2 in which the step of positioning the shield securing member on the shield to a position that prevents the catch from being disengaged from catching the circuit breaker assembly comprises sliding the shield securing member on the shield.

4. A method as set forth in claim 3 in which the step of sliding the shield securing member on the shield comprises sliding the shield securing member along a direction opposite a direction along which the shield is slid onto the circuit breaker assembly.

5. A method as set forth in claim 4 including the step of applying a seal to the shield securing member when the latter is in position that prevents the catch from being disengaged from catching the circuit breaker assembly to thereby prevent the catch from being disengaged from catching the circuit breaker assembly unless the seal is first broken.

6. A method as set forth in claim 5 in which the step of applying a seal to the shield securing member when the latter is in position that prevents the catch from being disengaged from catching the circuit breaker assembly comprises passing a seal member through a hole in the shield securing member.

7. A method as set forth in claim 1 including the step of applying a seal to the shield securing member when the latter is in position that prevents the catch from being disengaged from catching the circuit breaker assembly to thereby prevent the catch from being disengaged from catching the circuit breaker assembly unless the seal is first broken.

8. A method as set forth in claim 7 in which the step of applying a seal to the shield securing member when the latter is in position that prevents the catch from being disengaged from catching the circuit breaker assembly comprises passing a seal member through a hole in the shield securing member.

9. A method of shielding one or more exposed electric terminals at an end of a circuit breaker assembly, the method comprising:

providing a shield for assembly to the circuit breaker assembly in shielding relation to the one or more electric terminals, providing a shield securing member that is selectively positionable by sliding on the shield;

assembling the shield to the circuit breaker assembly to place the shield in shielding relation to the one or more electric terminals; and with the shield so assembled to the circuit breaker assembly sliding the shield securing member from a first position that allows disassembly of the shield from the circuit breaker assembly to a second position that prevents the shield from being disassembled from the circuit breaker assembly;

in which the step of sliding the shield securing member comprises sliding the shield securing member along a straight direction.

10. A method as set forth in claim 9 in which the step of assembling the shield to the circuit breaker assembly comprises sliding the shield onto the circuit breaker assembly.

11. A method as set forth in claim 10 in which the step of sliding the shield onto the circuit breaker assembly comprises sliding the shield along a straight direction, and the step of sliding the shield securing member on the shield along a straight direction comprises sliding the shield securing member along a straight direction that is opposite the straight direction along which the shield is slid onto the circuit breaker assembly.

12. A method of shielding one or more exposed electric terminals at an end of a circuit breaker assembly the method comprising:

providing a shield for assembly to the circuit breaker assembly in shielding relation to the one or more electric terminals;

providing a shield securing member that is selectively positionable by sliding on the shield;

assembling the shield to the circuit breaker assembly to place the shield in shielding relation to the one or more electric terminals; and with the shield so assembled to the circuit breaker assembly sliding the shield securing member from a first position that allows disassembly of the shield from the circuit breaker assembly to a second position that prevents the shield from being disassembled from the circuit breaker assembly;

including providing the shield with a catch that, when the shield is assembled to the circuit breaker assembly, catches with the circuit breaker assembly to prevent disassembly of the shield from the circuit breaker assembly unless the catch is first released from catching with the circuit breaker assembly, and in which the step of sliding the shield securing member from a first position that allows disassembly of the shield from the circuit breaker assembly to a second position that prevents the shield from being disassembled from the circuit breaker assembly includes allowing the catch to be released when the shield securing member is in the first position and preventing the catch from being released when the shield securing member is in the second position.

13. A method as set forth in claim 12 including providing the shield with two registering apertures, and in which the step of sliding the shield securing member from the first position to the second position comprises passing a portion of the shield securing member through the two apertures.

14. A method of shielding one or more exposed electric terminals at an end of a circuit breaker assembly the method comprising:

providing a shield for assembly to the circuit breaker assembly in shielding relation to the one or more electric terminals;

providing a shield securing member that is selectively positionable by sliding on the shield;

assembling the shield to the circuit breaker assembly to place the shield in shielding relation to the one or more electric terminals; and with the shield so assembled to the circuit breaker assembly, sliding the shield securing member from a first position that allows disassembly of the shield from the circuit breaker assembly to a second position that prevents the shield from being disassembled from the circuit breaker assembly;

including the step of applying a seal to the shield securing member when the latter is in the second position to prevent the shield securing member from being slid to the first position unless the seal is first broken.

15. A method as set forth in claim 14 in which the step of applying seal to the shield securing member when the latter is in the second position comprises passing a seal member through a hole in the shield securing member.

* * * * *